US009153869B1

(12) United States Patent
Lee et al.

(10) Patent No.: US 9,153,869 B1
(45) Date of Patent: Oct. 6, 2015

(54) HARMONIC SUPPRESSED DUAL FEED ANTENNA

(71) Applicant: Amazon Technologies, Inc., Reno, NV (US)

(72) Inventors: Tzung-I Lee, San Jose, CA (US); In Chul Hyun, San Jose, CA (US); Cheol Su Kim, San Jose, CA (US)

(73) Assignee: Amazon Technologies, Inc., Reno, NV (US)

( * ) Notice: Subject to any disclaimer, the term of this patent is extended or adjusted under 35 U.S.C. 154(b) by 357 days.

(21) Appl. No.: 13/718,628

(22) Filed: Dec. 18, 2012

(51) Int. Cl.
*H01Q 21/00* (2006.01)
*H01Q 9/04* (2006.01)
*H01Q 21/30* (2006.01)

(52) U.S. Cl.
CPC ..... *H01Q 9/0414* (2013.01); *H01Q 21/30* (2013.01)

(58) Field of Classification Search
CPC ..... H01Q 21/00
USPC ..... 343/893, 841, 700 MS, 702
See application file for complete search history.

(56) References Cited

U.S. PATENT DOCUMENTS

| | | | | |
|---|---|---|---|---|
| 7,268,730 | B2 * | 9/2007 | Park et al. | 343/700 MS |
| 7,791,546 | B2 * | 9/2010 | Hotta et al. | 343/702 |
| 8,111,195 | B2 * | 2/2012 | Hung et al. | 343/700 MS |
| 2009/0256771 | A1 * | 10/2009 | Onaka et al. | 343/841 |
| 2009/0273531 | A1 * | 11/2009 | Ishizuka et al. | 343/750 |
| 2011/0223858 | A1 * | 9/2011 | Wong et al. | 455/41.1 |
| 2012/0001815 | A1 * | 1/2012 | Wong et al. | 343/749 |

* cited by examiner

*Primary Examiner* — Huedung Mancuso
(74) *Attorney, Agent, or Firm* — Seyfarth Shaw LLP; Ilan N. Barzilay

(57) ABSTRACT

A wideband antenna apparatus including a harmonically suppressed low band antenna is provided. The low band antenna is configured as a folded monopole antenna with patch coupling for resonance in a first frequency band. A patch portion of the low band antenna is widely separated from a folded feed portion of the low band antenna to avoid slot resonances above the first frequency band. The patch portion is relatively large to avoid folding of the patch portion that could introduce resonances above the first frequency band. The wideband antenna apparatus may also include a high band antenna proximate with the low band antenna. The high band antenna may be a folded monopole patch coupled antenna configured for resonating in a second frequency band. The high band antenna may optionally be configured like the low band antenna to suppress resonances of the high band antenna above the second frequency band.

16 Claims, 8 Drawing Sheets

HARMONIC SUPPRESSED DUAL FEED ANTENNA

BACKGROUND

The increasing use of wireless communication links between a large variety of devices has led to numerous advancements in antenna design. Mobile devices such as mobile phones communicate wirelessly in a number of different frequency bands that are specified in various industry standards. Various antenna designs are incorporated in wireless devices such as mobile phones to facilitate communication on one or more appropriate frequency bands, in accordance with the standards. Mobile devices may include multiband antenna configurations that facilitate communication on more than one frequency band. However, it has been challenging to design multiband antennas that may provide acceptable performance in space constrained applications such as mobile phones and other mobile communication devices.

BRIEF DESCRIPTION OF DRAWINGS

For a more complete understanding of the present disclosure, reference is now made to the following description taken in conjunction with the accompanying drawings.

DETAILED DESCRIPTION

The close proximity between a high band antenna and a low band antenna in a multiband antenna structure can cause mutual electromagnetic coupling between the low band antenna and the high band antenna. Low band antennas which are designed to operate in a predetermined low frequency band can also resonate at harmonic frequencies above the low frequency band. The harmonic resonation of the low band antenna in the operating band of the nearby high band antenna detrimentally affects performance of both the high band antenna and the low band antenna and can substantially reduce efficiency of the multiband antenna structure.

Aspects of the present disclosure include a multiband antenna structure including a low band antenna configured with a high band antenna. The low band antenna and the high band antenna are both configured as wide band antennas. The low band antenna is configured to reduce resonances in the band of the high band antenna. The high band antenna is configured to reduce resonances in the band of the low band antenna. Thus harmonic interference between the antennas may be reduced.

In one aspect of the disclosure, the low band antenna is a harmonic suppressed patch coupled folded monopole antenna. The high band antenna may also be a harmonic suppressed patch coupled folded monopole antenna. However, in certain aspects of the present disclosure the high band antenna may naturally avoid creating resonances in the band of the low band antenna, so particular configurations of the high band antenna for harmonic suppression may be optional.

Figure 1A:
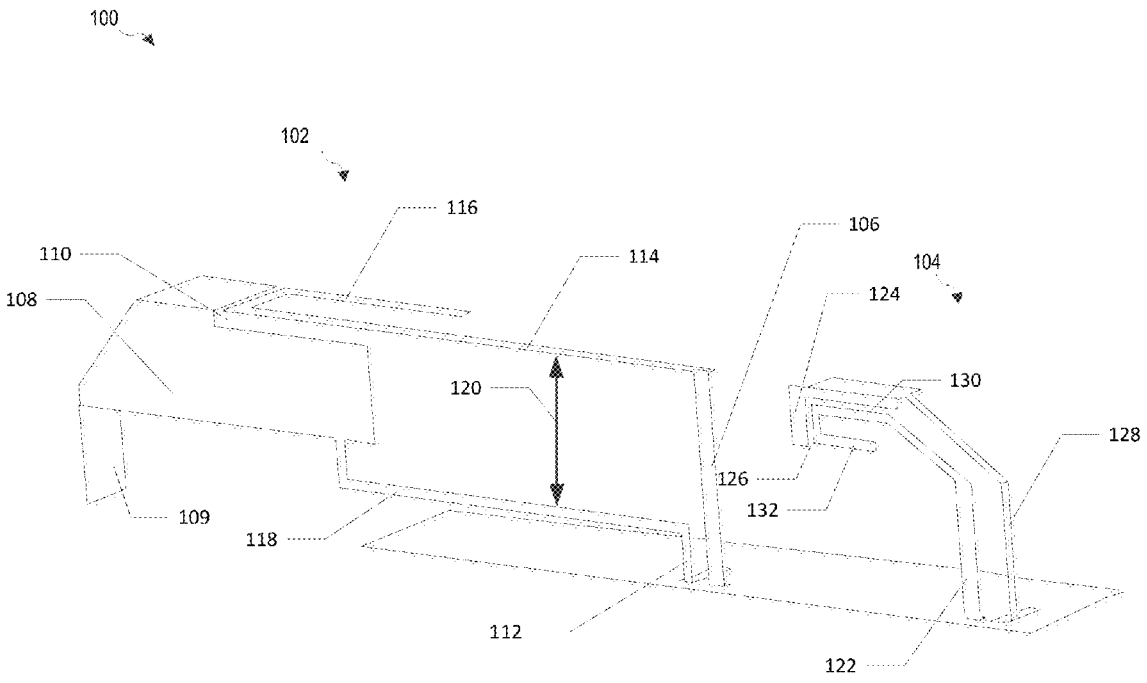
FIG. 1A is a pictorial diagram showing a multiband antenna apparatus according to one aspect of the disclosure.

A multiband antenna structure 100 according to aspects of the present disclosure is described with reference to FIG. 1A. The multiband antenna structure 100 includes a low band antenna 102 and a high band antenna 104. The low band antenna 102 includes a folded feed portion 106 and a patch portion 108 and is configured to operate in the low frequency band between about 700 MHz and about 960 MHz. The patch portion 108 includes a tab 109 and is electromagnetically coupled to the folded feed portion 106 via patch gap 110 and edge coupled to an energy source via a ground strip 112. The folded feed portion 106 includes a first arm 114 and a second arm 116 parallel to the first arm 114. The ground strip 112 includes a ground arm portion 118 spaced away from the first arm 114 by a separation distance 120.

According to one aspect of the present disclosure, the patch portion 108 is non-folded. For example, in one aspect, the patch portion 108 does not include a second arm portion extending back in the direction of the ground arm portion 118.

The high band antenna 104 includes a folded feed portion 122 and a patch portion 124 and is configured to operate in the high frequency band between about 1.7 GHz and 2.2 GHz. The patch portion 124 is electromagnetically coupled to the folded feed portion 122 via a patch gap 126 and edge coupled to a ground feed via a ground strip 128. The folded feed portion 122 includes a first arm 130 and a second arm 132 parallel to the first arm 130.

According to aspects of the present disclosure, high band resonances of the low band antenna 102 are suppressed by parasitic coupling of the grounded patch portion 108. The patch portion 108 also provides lower resonance mode matching for the low band antenna 102. According to further aspects of the present disclosure, the patch portion 108 is configured with a large area at the end of the parasitic ground strip 112. The large area suppresses high band resonances by allowing the patch portion to be constructed without a folding arm, which would create one or more high band resonances.

Other sources of harmonic resonances that can be suppressed according to the aspects of the present disclosure include slot mode resonances. Slot mode resonances can occur when an antenna element includes a narrow slot in an element or between two elements. The slot may resonate electromagnetic waves in the manner of a di-pole antenna, for example. According to an aspect of the present disclosure, the ground arm portion 118 is configured as a thin strip with a comparatively wide separation 120 from the first arm 114. The separation 102 may be sufficiently large to avoid creating a narrow slot between the folded feed portion 106 and the patch portion 108 that could create slot mode high frequency resonances, for example. Thus slot mode resonances may be reduced.

The patch portion 124 of the high band antenna 104 provides high frequency resonance mode matching for the high band antenna 104. The high band antenna 104 may be configured using the same harmonic suppression techniques described above with regard to the low band antenna 102 in structures where it could be desirable to suppress harmonics above the range of the high band antenna 104. However, persons having ordinary skill in the art should appreciate that the described harmonic suppression structure including wide separation between the folded feed portion 122 and the patch portion 124 is optional in the high band antenna 104 as it may not affect lower frequency harmonics in the band of the low band antenna 102, for example.

Figure 1B:
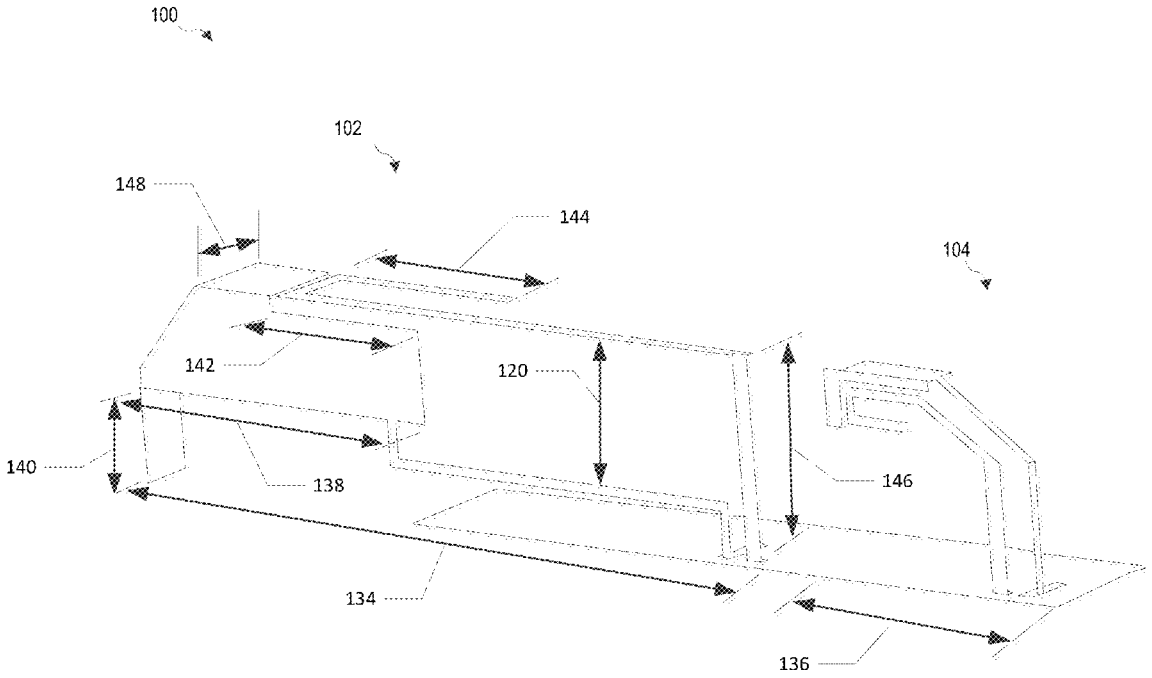
FIG. 1B is a pictorial diagram showing physical dimensions in an example of an antenna apparatus according to one aspect of the disclosure.

Referring to FIG. 1B, certain primary dimensions are shown in an example of a suppressed harmonic multiband antenna structure 100 according to aspects of the present disclosure. In this example, a length 134 of the low band antenna 102 is 41 mm and a length 136 of the low band antenna 104 is 13 mm. A length 138 of the patch portion 108 is 19 mm and a height 140 of the tab 109 is 5 mm. The patch portion 108 overlaps the folded feed portion 106 along a length 142 of 10 mm. A length 144 of the second arm 116 is 12 mm. A height 146 of the low band antenna 102 is 11 mm and a width 148 of the low band antenna 102 is 5 mm. In this example, the separation distance 120 is about 8 mm to 9 mm.

Figure 2:
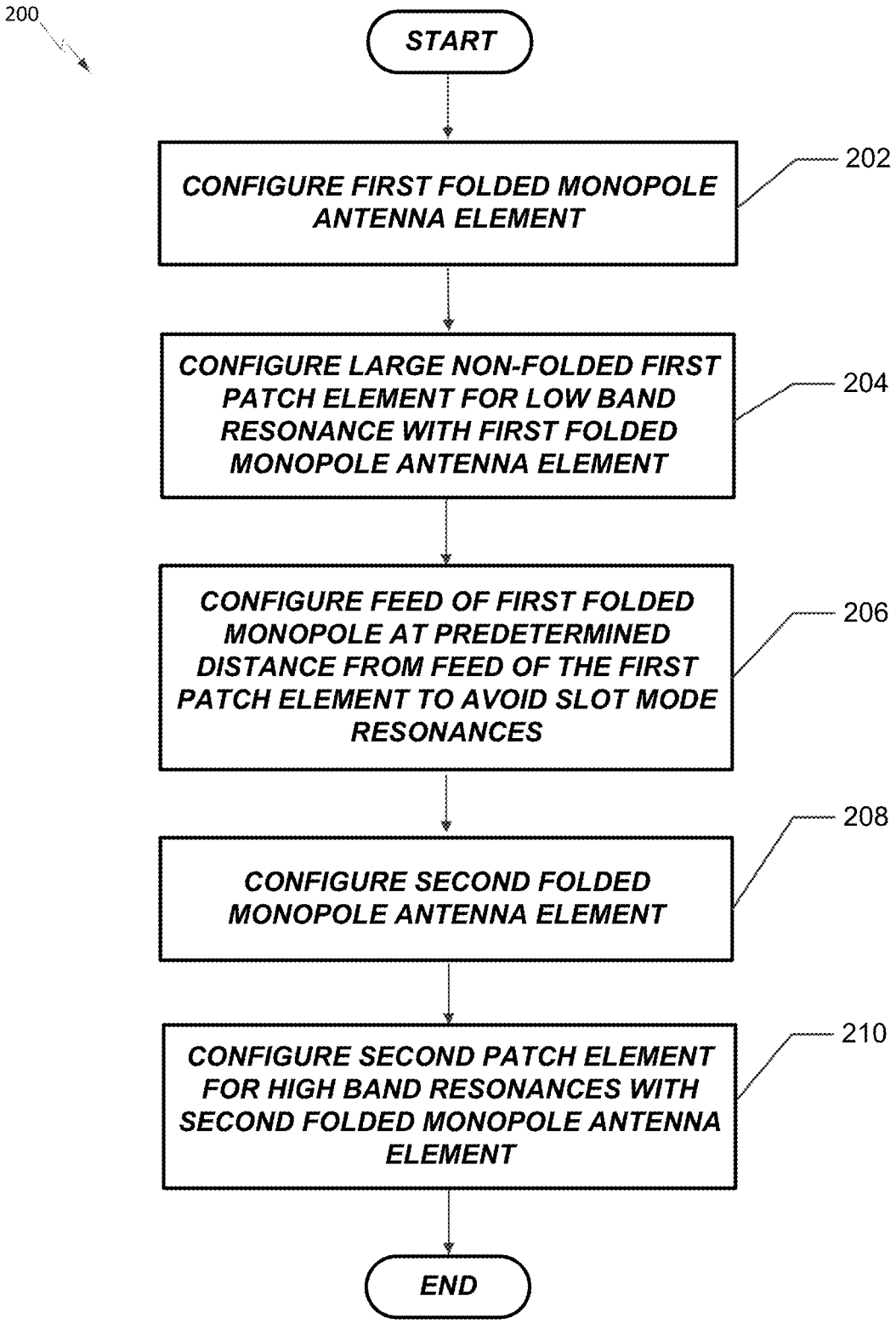
FIG. 2 is a flow diagram illustrating an exemplary routine for configuring a multiband antenna apparatus to aspects of the present disclosure.

A method for configuring a multiband antenna structure according to one aspect of the present disclosure is described with reference to the process flow diagram 200 shown in FIG. 2. At block 202, the method includes configuring a first folded monopole antenna element. At block 204, the method includes configuring a non-folded first patch element for electromagnetic coupling with the first folded monopole antenna to generate a primary resonance with the first folded monopole antenna element in a predetermined low band. According to aspects of the present disclosure The non-folded first patch element is configured to be large enough to resonate with the first folded monopole antenna element in the low band without including a folded patch portion. At block 206, the method includes configuring a feed of the first folded monopole antenna element at a predetermined distance from a feed of the patch portion. The predetermined distance may be large enough to reduce slot mode resonances.

At block 208, the method includes configuring a second folded monopole antenna element proximate with the first folded monopole antenna element. At block 210, the method includes configuring a second patch element for electromagnetic coupling with the second folded monopole antenna element to generate a primary resonance with the second folded monopole antenna element in a high band.

A method for configuring a multiband antenna structure such as the method described above with reference to FIG. 2 can be performed using known techniques in a manufacturing environment. For example, one or more portions of the multiband antenna structure may be formed in a printed circuit board manufacturing process in which conductive traces and patches are etched on a substrate. Multiple printed circuit boards may be coupled together to provide antenna elements in one or more planes, for example. Portions of the multiband antenna structure may also be formed as metal traces or patches on flexible substrates in a flexible circuit manufacturing environment or may be deposited on a base structure using various known metal deposition techniques such sputtering, for example. Metal stamping techniques may also be used to form portions of the multiband antenna structure, which can be formed without a corresponding substrate, for example. Metal stampings forming portions of the multiband antenna structure may be assembled to supportive structures such as thermoplastic housings of a device or may be incorporated therein using techniques such as insert molding, for example. Small scale multiband antenna structures according to aspects of the present disclosure may be formed on integrated circuit chips using known integrated circuit manufacturing processes, for example.

Figure 3A:
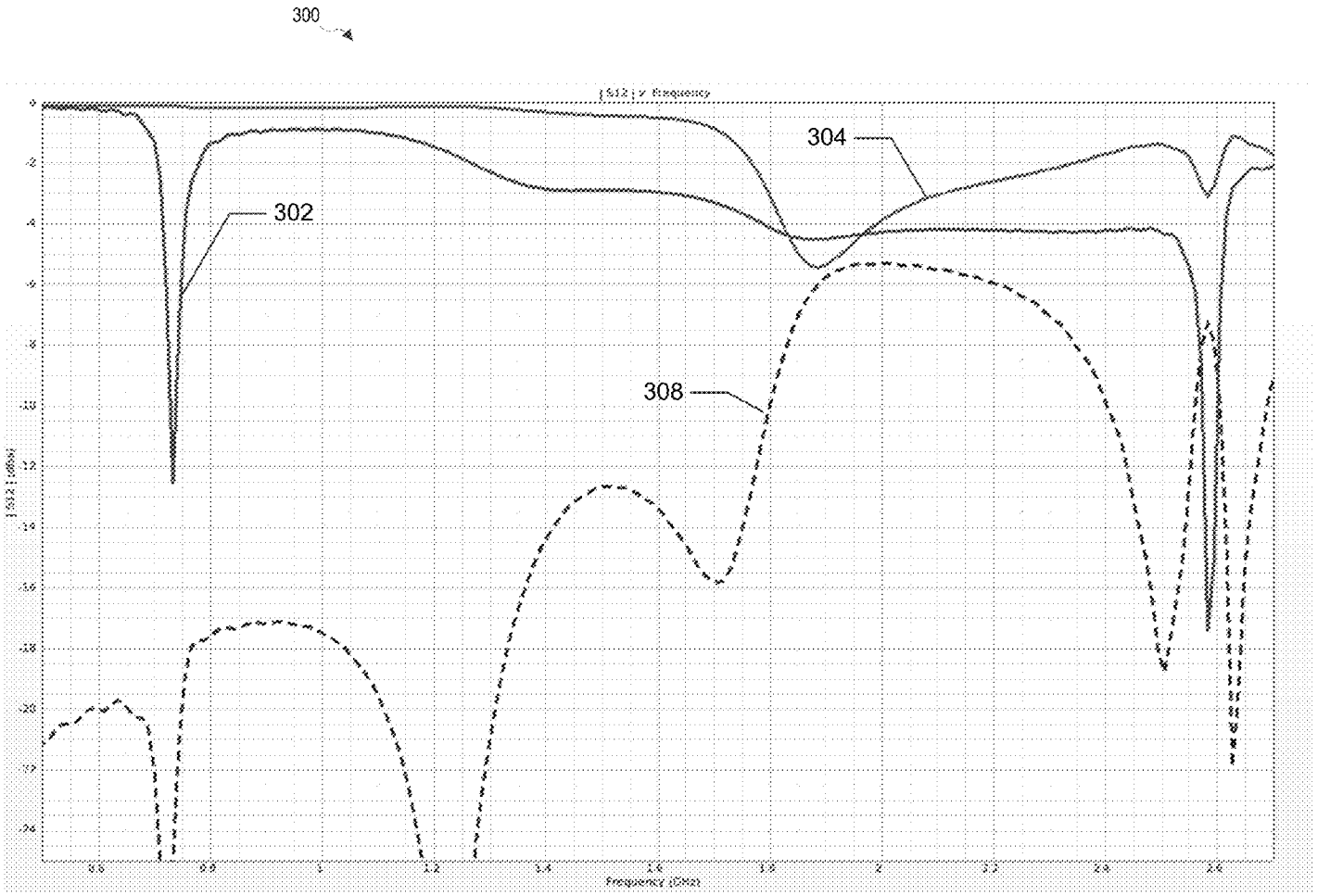
FIG. 3A is a graph that shows an example of return loss in previously known multiband antenna structures.

FIG. 3A is a return loss graph illustrating an example of performance of a previously known wide band antenna structures in which harmonics of the low band antenna element are not suppressed and appear as resonances in the band of the high band antenna. This resonance of the low band antenna in the high band range is an example of mutual coupling, which can occur between closely spaced antenna elements. Undesirable effects of such mutual coupling include significant decrease in efficiency of the wideband antenna structure as well as altered impedances and radiation patterns of the wideband antenna structure. A low band antenna element resonance plot 302 shows a low band resonance of the low band antenna element at about 0.72 GHz and about −4 dB harmonics in the high frequency band above 1.8 GHz. A high band antenna element resonance plot 304 shows a high band resonance of the high band antenna element at about 1.87 GHz. The harmonics of the low band antenna above 1.8 GHz influence the high band antenna resonance and cause poor performance of the high band antenna element as above 1.9 GHz, for example. The low band antenna element resonance plot 302 also shows a large harmonic resonance at about 2.58 GHz. The high band antenna element resonance plot 304 shows a corresponding resonance at about 2.58 GHz due to the mutual coupling between the high band antenna element and the low band antenna element. Combining the low band antenna element resonance plot 302 and the high band antenna element resonance plot 304 provides an antenna isolation plot 308 of the previously known multiband antenna structure of this example. The antenna isolation plot 308 shows poor isolation in the high band between about 1.8 and GHz 2.3 GHz and around the 2.58 GHz harmonics.

Figure 3B:
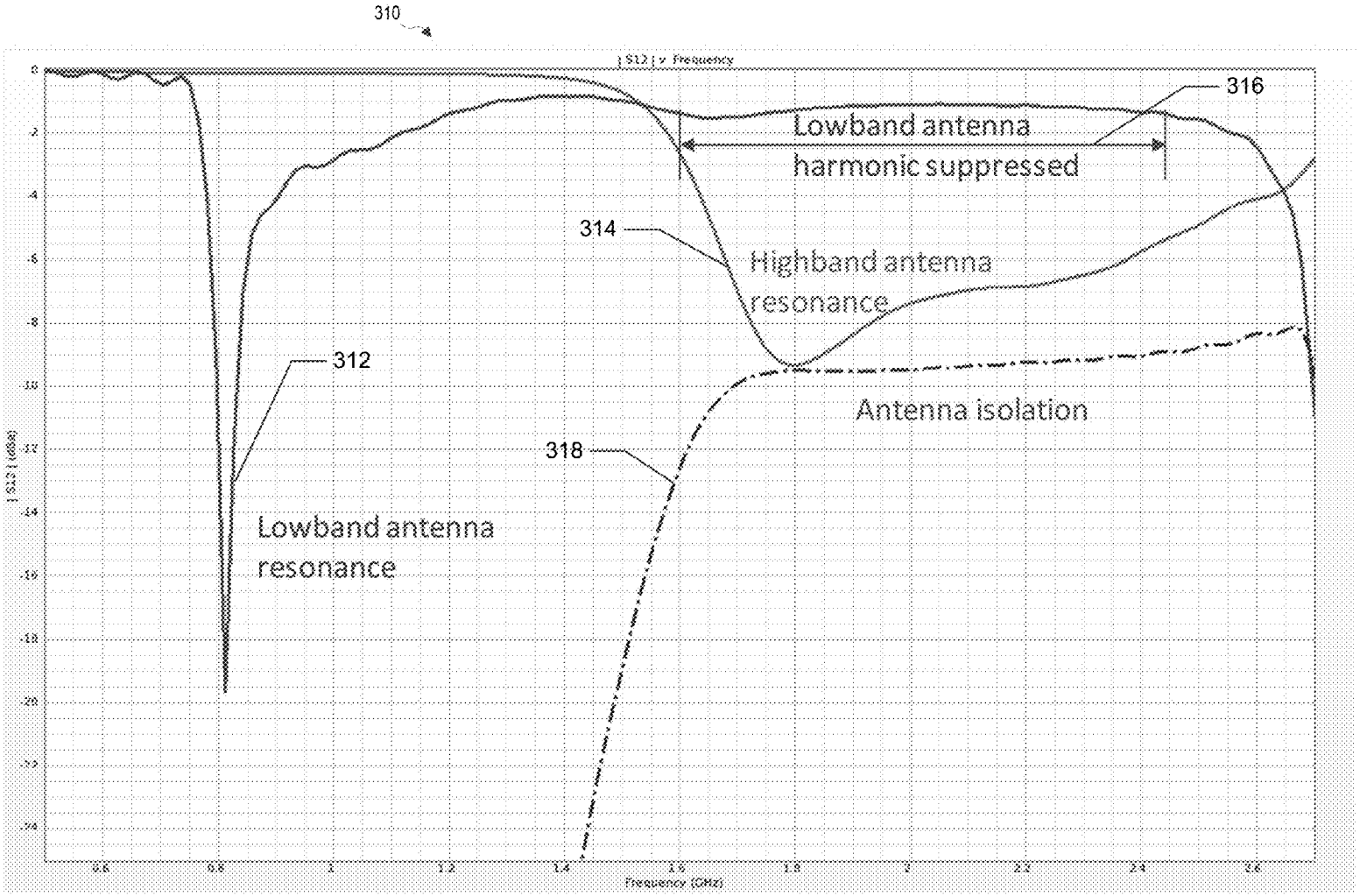
FIG. 3B is graph that plots the return loss of a multiband antenna apparatus according to aspects of the present disclosure.

Performance of a multiband antenna structure according to aspects of the present disclosure is described with reference to the multiband antenna structure 100 shown in FIG. 1A and the return loss graph 310 shown in FIG. 3B. A low band antenna resonance plot 312 shows a low band resonance of the low band antenna 102 at about 0.8 GHz. A high band antenna resonance plot 314 shows a high band resonance of the high band antenna 104 at about 1.8 GHz. The various aspects of the present disclosure including the non-folded patch portion 108 and the wide separation 120 between the ground arm portion 118 and the first arm 114 of the folded feed portion 106 suppress harmonics of the low band antenna 102 in the band of the high band antenna 104. The absence of higher frequency harmonics may be seen in the high band portion 316 of the low band antenna resonance plot 312, between about 1.6 GHz and 2.5 GHz, for example. Combining the low band antenna resonance plot 312 and the high band antenna resonance plot 314 provides an antenna isolation plot 318 of the multiband antenna structure 100. The antenna isolation plot 318 shows isolation between about −10 dB and −8 dB in the frequency range of the high band antenna resonances, between about 1.7 GHz and about 2.65 GHz.

Figure 4:
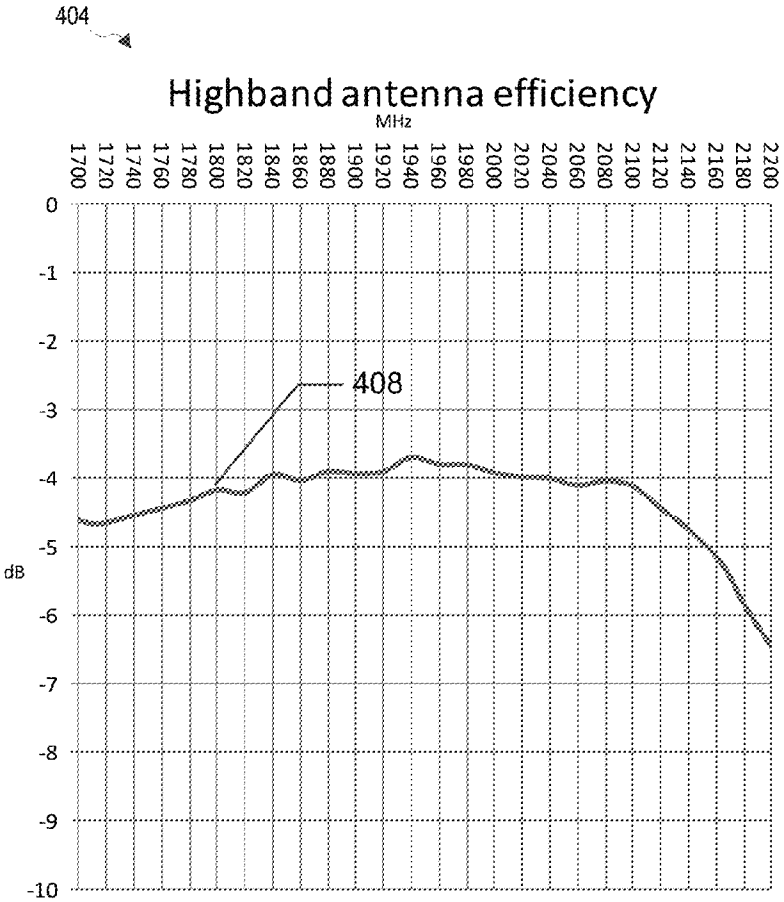
FIG. 4 is graph that plots efficiencies of a low band portion and high band portion of a multiband antenna structure according to aspects of the present disclosure.
Figure 4:
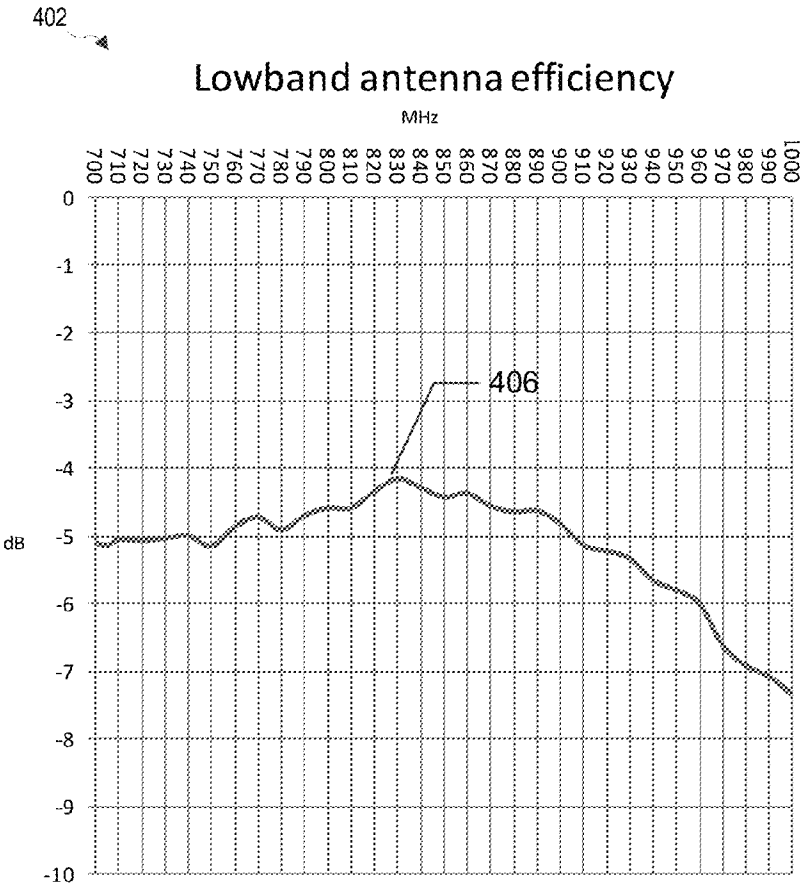

Mutual coupling between multiband antenna elements may significantly reduce antenna efficiency. However, according to aspects of the present disclosure, isolation between the low band antenna 102 and the low band antenna 104 of the multiband antenna structure 100 prevents significant loss of efficiency. The efficiency of a multiband antenna structure according to aspects of the present disclosure is described with reference to the multiband antenna structure 100 shown in FIG. 1A and the efficiency graphs 402, 404 shown in FIG. 4. A low band antenna efficiency plot 406 shows good efficiency of about −4 dB in the frequency band of the low band antenna around 830 MHz, for example. A high band antenna efficiency plot 408 shows good efficiency of about −4 dB in the frequency band of the high band antenna 104 around 1800 MHz, for example. The efficiency plots shown in FIG. 4 may be achieved with the antenna configuration shown in FIG. 1A.

In some circumstances it may be useful to configure a low band antenna with suppressed harmonics to avoid mutual coupling with other or interference with other components in an environment. A suppressed harmonic low band antenna may be constructed as described in FIG. 1A without including the high band antenna 104, for example.

Figure 5:
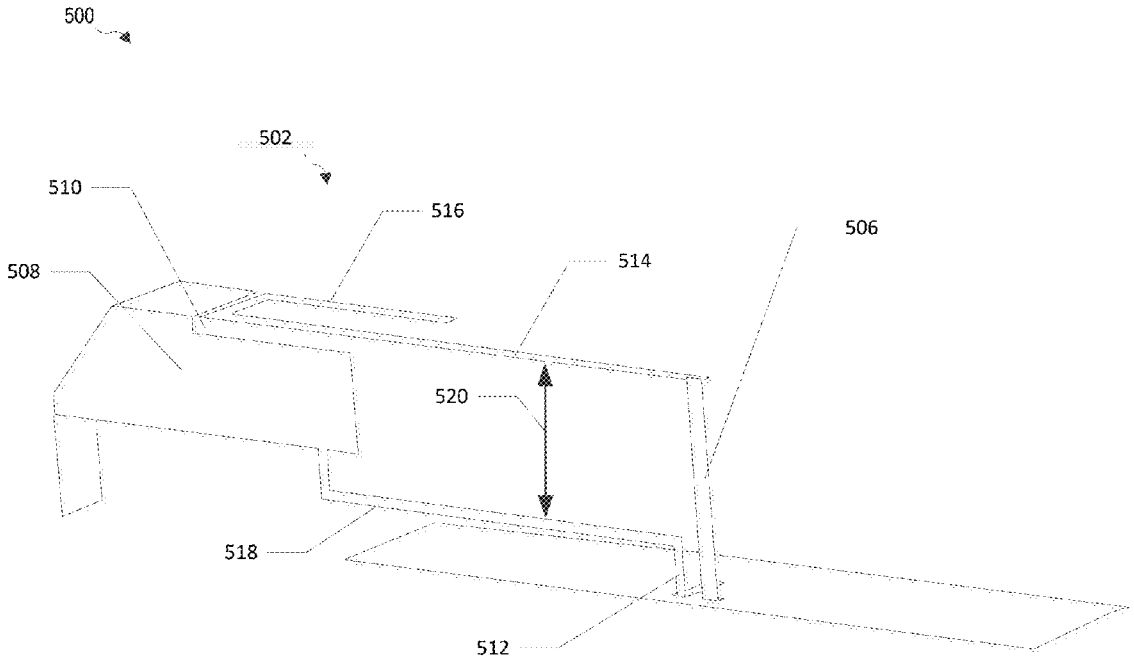
FIG. 5 is a pictorial diagram showing a harmonic suppressed low band antenna apparatus according to one aspect of the disclosure.

According to an aspect of the present disclosure that is described with reference to FIG. 5, an antenna structure 500 includes a suppressed harmonic low band antenna 502. The antenna structure 500 includes a low band antenna 502 configured with a folded feed portion 506 and a patch portion 508. The patch portion 508 is electromagnetically coupled to the folded feed portion 506 via patch gap 510 and edge coupled to an energy source via a ground strip 512. The folded feed portion 506 includes a first arm 514 and a second arm 516 parallel to the first arm 514. The ground strip 512 includes a ground arm portion 518 spaced away from the first arm 514 by a separation distance 520.

According to one aspect of the present disclosure, the patch portion 508 is non-folded. In other words, the patch portion 508 does not include a second arm portion extending back in the direction of the ground arm portion 518.

In some circumstances it may be useful to configure the high band antenna in a multiband antenna structure to suppress harmonics from the high band antenna structure above the high band, for example.

Figure 6:
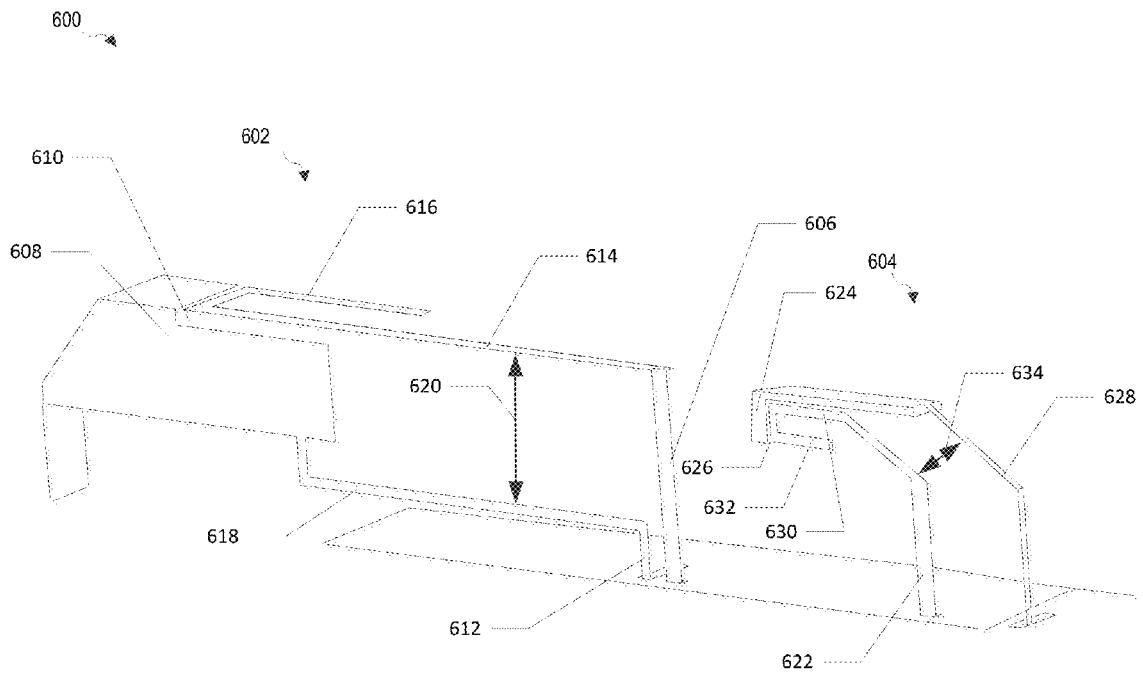
FIG. 6 is a pictorial diagram showing a multiband antenna apparatus according to one aspect of the disclosure.

A multiband antenna structure 600 that is configured to suppress harmonics both the low band antenna and the high band antenna according to aspects of the present disclosure is described with reference to FIG. 6. The multiband antenna structure 600 includes a low band antenna 602 and a high band antenna 604. The low band antenna 602 includes a folded feed portion 606 and a patch portion 608. The patch portion 608 is electromagnetically coupled to the folded feed portion 606 via patch gap 610 and edge coupled to an energy source via a ground strip 612. The folded feed portion 606 includes a first arm 614 and a second arm 616 parallel to the first arm 614. The ground strip 612 includes a ground arm portion 618 spaced away from the first arm 614 by a separation distance 620.

According to one aspect of the present disclosure, the patch portion 608 is non-folded. In other words, the patch portion 608 does not include a second arm portion extending back in the direction of the ground arm portion 618.

The high band antenna 604 includes a folded feed portion 622 and a patch portion 624. The patch portion 624 is electromagnetically coupled to the folded feed portion 622 via a patch gap 626 and edge coupled to ground feed via a ground strip 628. The folded feed portion 622 includes a first arm 630 and a second arm 632 parallel to the first arm 628.

According to aspects of the present disclosure, high band resonances of the low band antenna 602 are suppressed by parasitic coupling of the grounded patch portion 608. The patch portion 608 also provides lower resonance mode matching for the low band antenna 602. According to further aspects of the present disclosure, the patch portion 608 is configured with a large area at the end of the parasitic ground strip 612. The large area suppresses high band resonances by allowing the patch portion to be constructed without a folding arm, which would create one or more high band resonances. According to yet another aspect of the present disclosure, the ground arm portion 618 is configured as a thin strip with a comparatively wide separation 620 from the first arm 614. The separation 602 is sufficiently large to avoid creating a narrow slot between the folded feed portion 606 and the patch portion 608 that could create slot mode high frequency resonances, for example.

According to aspects of the present disclosure, high band resonances of the high band antenna 604 are suppressed by parasitic coupling of the grounded patch portion 624. The patch portion 624 of the high band antenna 604 also provides high frequency resonance mode matching for the high band antenna 604. The high band antenna 604 is configured using the same harmonic suppression techniques described above with regard to the low band antenna 602. According to further aspects of the present disclosure, the patch portion 624 is configured with a large area at the end of the ground strip 628. The large area suppresses high band resonances by allowing the patch portion 624 to be constructed without a folding arm, which would create one or more high band resonances. According to yet another aspect of the present disclosure, the ground strip 628 is configured with a comparatively wide separation 634 from the folded feed portion 622. The separation 634 may be sufficiently large to avoid creating a narrow slot between the folded feed portion 622 and the ground strip 628 that could create slot mode high frequency resonances, for example.

As discussed above, the various aspects of the present disclosure may be implemented in a wide variety of operating environments, which in some cases may include one or more mobile devices, user computers, computing devices, or processing devices which may be used to operate any of a number of applications. Mobile devices may include any of a number of cellular wireless and handheld devices such as mobile phones, smart phones and tablet computers running mobile software and capable of supporting a number of networking and messaging protocols. User computers and computing devices may include laptop computers and general purpose personal computers running a standard operating system, for example Such a system also may include a number of workstations running any of a variety of commercially-available operating systems and other known applications for purposes such as development and database management. These devices also may include other electronic devices, such as dummy terminals, thin-clients, gaming systems, and other devices capable of communicating via a network.

The environment may include a variety of data stores and other memory and storage media as discussed above. These may reside in a variety of locations, such as on a storage medium local to (and/or resident in) one or more of the computers or remote from any or all of the computers across the network. In a particular set of embodiments, the information may reside in a storage-area network ("SAN") familiar to those skilled in the art. Similarly, any necessary files for performing the functions attributed to the computers, servers, or other network devices may be stored locally and/or remotely, as appropriate. Where a system includes computerized devices, each such device may include hardware elements that may be electrically coupled via a bus, the elements including, for example, at least one central processing unit (CPU), at least one input device (e.g., a mouse, keyboard, controller, touch screen, or keypad), and at least one output device (e.g., a display device, printer, or speaker). Such a system may also include one or more storage devices, such as disk drives, optical storage devices, and solid-state storage devices such as random access memory ("RAM") or read-only memory ("ROM"), as well as removable media devices, memory cards, flash cards, etc.

Such devices also may include a computer-readable storage media reader, a communications device (e.g., a modem, a network card (wireless or wired), an infrared communication device, etc.), and working memory as described above. The computer-readable storage media reader may be connected with, or configured to receive, a computer-readable storage medium, representing remote, local, fixed, and/or removable storage devices as well as storage media for temporarily and/or more permanently containing, storing, transmitting, and retrieving computer-readable information. The system and various devices also typically will include a number of software applications, modules, services, or other elements located within at least one working memory device, including an operating system and application programs, such as a client application or Web browser. It should be appreciated that alternate embodiments may have numerous variations from that described above. For example, customized hardware might also be used and/or particular elements might be implemented in hardware, software (including portable software, such as applets), or both. Further, connection to other computing devices such as network input/output devices may be employed.

Based on the disclosure and teachings provided herein, a person of ordinary skill in the art will appreciate other ways and/or methods to implement the various aspects and embodiments. The specification and drawings are, accordingly, to be regarded in an illustrative rather than a restrictive sense. It will, however, be evident that various modifications and changes may be made thereunto without departing from the broader spirit and scope of the disclosure as set forth in the claims.

What is claimed is:

1. An antenna structure, comprising:

a low band folded monopole antenna comprising:

a first folded feed portion and a first non-folded patch portion electromagnetically coupled via a first gap with the first folded feed portion, the first non-folded patch portion configured for resonating with the first folded feed portion in a first frequency band, and the first non-folded patch portion including a first ground strip separated from the first folded feed portion by a first distance predetermined to reduce slot mode resonances of the low band folded monopole antenna; and a high band folded monopole antenna comprising:

a second folded feed portion and a second patch portion electromagnetically coupled via a second gap with the second folded feed portion, the second patch portion configured for resonating with the second folded feed portion in a second frequency band higher than the first frequency band;

in which the low band folded monopole antenna is configured to suppress harmonics in the second frequency band.

2. The antenna structure of claim 1, in which the second patch portion is non-folded, the second patch portion further comprising a second ground strip separated from the second folded feed portion by a second distance predetermined to reduce slot mode resonances of the high band folded monopole antenna.

3. The antenna structure of claim 2, in which the first frequency band is in a range of about 700 MHz to 960 MHz and the second frequency band is in a range of about 1.7 GHz to 2.2 GHz.

4. An antenna structure comprising:

a low band folded monopole antenna including:

a first folded feed portion and a first non-folded patch portion electromagnetically coupled via a first gap with the first folded feed portion, the first non-folded patch portion configured for resonating with the first folded feed portion in a first frequency band; and a high band folded monopole antenna including:

a second folded feed portion and a second patch portion electromagnetically coupled via a second gap with the second folded feed portion, the second patch portion configured for resonating with the second folded feed portion in a second frequency band higher than the first frequency band.

5. The antenna structure of claim 4, further comprising:

the first non-folded patch portion including a first ground strip separated from the first folded feed portion by a first distance predetermined to reduce slot mode resonances of the low band folded monopole antenna.

6. The antenna structure of claim 4, in which the low band folded monopole antenna is configured to suppress harmonics above the first frequency band.

7. The antenna structure of claim 4, in which the first frequency band is in a range of about 700 MHz to 960 MHz.

8. The antenna structure of claim 4, in which the second patch portion is non-folded.

9. The antenna structure of claim 4, in which, the second patch portion further comprising a second ground strip separated from the second folded feed portion by a second distance predetermined to reduce slot mode resonances of the high band folded monopole antenna.

10. The antenna structure of claim 4, in which the second frequency band is in a range of about 1.7 GHz to 2.2 GHz.

11. A method for configuring a multiband antenna structure, the method comprising:

configuring a first folded monopole antenna element;

configuring an electromagnetic coupling between a non-folded first patch element and the first folded monopole antenna element, the electromagnetic coupling resonating in a first frequency band and suppressing harmonics above the first frequency band;

configuring a second folded monopole antenna element proximate with the first folded monopole antenna element; and configuring a second patch element for electromagnetic coupling with the second folded monopole antenna element to generate a primary resonance with the second folded monopole antenna element in a second frequency band above the first frequency band.

12. The method of claim 11, further comprising:

configuring a feed of the first folded monopole antenna element at a predetermined distance from a feed of the non-folded first patch element, in which the predetermined distance is large enough to reduce slot mode resonances of the first folded monopole antenna element above the first frequency band.

13. The method of claim 11, in which the first frequency band is in a range of about 700 MHz to 960 MHz.

14. The method of claim 11, in which the second patch element is non-folded.

15. The method of claim 11, further comprising:

separating the second patch element from the second folded monopole antenna element by a second distance predetermined to reduce slot mode resonances of the second folded monopole antenna element.

16. The method of claim 11, in which the second frequency band is in a range of about 1.7 GHz to 2.2 GHz.

* * * * *